US008344826B2

(12) United States Patent
Rossiter et al.

(10) Patent No.: US 8,344,826 B2
(45) Date of Patent: Jan. 1, 2013

(54) PHASED-ARRAY ANTENNA FILTER AND DIPLEXER FOR A SUPER ECONOMICAL BROADCAST SYSTEM

(75) Inventors: Chris Rossiter, Westbrook, ME (US); Robert Dunning, Naples, ME (US); Torbjorn Johnson, Vaxholm, ME (US)

(73) Assignee: SPX Corporation, Charlotte, NC (US)

( * ) Notice: Subject to any disclaimer, the term of this patent is extended or adjusted under 35 U.S.C. 154(b) by 675 days.

(21) Appl. No.: 12/427,674

(22) Filed: Apr. 21, 2009

(65) Prior Publication Data

US 2009/0284325 A1 Nov. 19, 2009

Related U.S. Application Data

(60) Provisional application No. 61/046,753, filed on Apr. 21, 2008.

(51) Int. Cl.
*H01P 3/12* (2006.01)
*H01P 5/12* (2006.01)

(52) U.S. Cl. ..... 333/134; 333/135; 333/212

(58) Field of Classification Search ..... 333/134, 333/135, 212, 126–129
See application file for complete search history.

(56) References Cited

U.S. PATENT DOCUMENTS

| | | | | |
|---|---|---|---|---|
| 4,316,108 | A | 2/1982 | Rogers, Jr. | |
| 5,023,866 | A * | 6/1991 | De Muro | 370/278 |
| 5,262,742 | A * | 11/1993 | Bentivenga | 333/203 |
| 5,471,177 | A * | 11/1995 | Hudspeth et al. | 333/126 |
| 6,122,533 | A | 9/2000 | Zhang et al. | |
| 6,812,824 | B1 | 11/2004 | Goldinger et al. | |
| 6,865,786 | B2 | 3/2005 | Nakao et al. | |
| 2006/0193559 | A1 * | 8/2006 | Koizumi et al. | 385/39 |
| 2007/0254587 | A1 | 11/2007 | Schadler et al. | |

FOREIGN PATENT DOCUMENTS

JP 2000357903 A * 12/2000

* cited by examiner

*Primary Examiner* — Robert Pascal
*Assistant Examiner* — Kimberly Glenn
(74) *Attorney, Agent, or Firm* — Baker & Hostetler LLP

(57) ABSTRACT

A phased-array antenna filter and diplexer for a super economical broadcast system are provided. The filter and diplexer includes a signal divider tee diplexer, a receive filter and a transmit filter. The diplexer includes a tee branch point, an antenna port, a transmit port and a receive port. The receive filter includes a flat, multi-pole bandpass filter, an input port and an output port, where the input port is coupled to the diplexer receive port to define a receive signal path, from the tee branch point to the receive input port, that has a length of approximately one quarter receive wavelength. The transmit filter includes a folded, multi-pole bandpass filter, an input port and an output port, where the output port is coupled to the diplexer transmit port to define a transmit signal path, from the tee branch point to the transmit output port, that has a length of approximately one quarter transmit wavelength.

16 Claims, 4 Drawing Sheets

PHASED-ARRAY ANTENNA FILTER AND DIPLEXER FOR A SUPER ECONOMICAL BROADCAST SYSTEM

CROSS-REFERENCE TO RELATED APPLICATIONS

This application claims priority to U.S. Provisional Patent Application Ser. No. 61/046,753 (filed on Apr. 21, 2008, entitled "Phased-Array Antenna Filter and Diplexer for a Super Economical Broadcast System"), the contents of which are incorporated herein by reference in their entirety.

FIELD OF THE INVENTION

The present invention relates, generally, to cellular communication systems. More particularly, the present invention relates to a filter and diplexer (or duplexer) for a phased-array antenna.

BACKGROUND OF THE INVENTION

Cellular radiotelephone system base transceiver stations (BTSs), at least for some United States (U.S.) and European Union (EU) applications, may be constrained to a maximum allowable effective isotropically radiated power (EIRP) of 1640 watts. EIRP, as a measure of system performance, is a function at least of transmitter power and antenna gain. As a consequence of restrictions on cellular BTS EIRP, U.S., EU, and other cellular system designers employ large numbers of BTSs in order to provide adequate quality of service to their customers. Further limitations on cells include the number of customers to be served within a cell, which can make cell size a function of population density.

One known antenna installation has an antenna gain of 17.5 dBi, a feeder line loss of 3 dB (1.25" line, 200 ft mast) and a BTS noise factor of 3.5 dB, such that the Ga−NFsys=17.5−3.5−3.0=11 dBi (in uplink). Downlink transmitter power is typically 50 W. With feeder lines, duplex filter and jumper cables totaling −3.5 dB, the Pa input power to antenna is typically 16 W, such that the EIRP is 16 W+17.5 dB=1,000 W.

In many implementations, each BTS is disposed near the center of a cell, variously referred to in the art by terms such as macrocell, in view of the use of still smaller cells (microcells, nanocells, picocells, etc.) for specialized purposes such as in-building or in-aircraft services. Typical cells, such as those for city population density, have radii of less than 3 miles (5 kilometers). In addition to EIRP constraints, BTS antenna tower height is typically governed by various local or regional zoning restrictions. Consequently, cellular communication providers in many parts of the world implement very similar systems.

Restrictions on cellular BTS EIRP and antenna tower height vary within each country. Not only is the global demand for mobile cellular communications growing at a fast pace, but there are literally billions of people, in technologically-developing countries such as India, China, etc., that currently do not have access to cellular services despite their willingness and ability to pay for good and inexpensive service. In some countries, government subsidies are currently facilitating buildout, but minimization of the cost and time for such subsidized buildout is nonetheless desirable. In these situations, the problem that has yet to be solved by conventional cellular network operators is how to decrease capital costs associated with cellular infrastructure deployment, while at the same time lowering operational expenses, particularly for regions with low income levels and/or low population densities. An innovative solution which significantly reduces the number of conventional BTS site-equivalents, while reducing operating expenses, is needed.

SUMMARY OF THE INVENTION

Embodiments of the present invention provide a phased-array antenna filter and diplexer for a super economical broadcast system.

In one embodiment, the filter and diplexer includes a signal divider tee diplexer, a receive filter and a transmit filter. The diplexer includes a tee branch point, an antenna port, a transmit port and a receive port. The receive filter includes a flat, multi-pole bandpass filter, an input port and an output port, where the input port is coupled to the diplexer receive port to define a receive signal path, from the tee branch point to the receive input port, that has a length of approximately one quarter receive wavelength. The transmit filter includes a folded, multi-pole bandpass filter, an input port and an output port, where the output port is coupled to the diplexer transmit port to define a transmit signal path, from the tee branch point to the transmit output port, that has a length of approximately one quarter transmit wavelength.

There have thus been outlined, rather broadly, certain embodiments of the invention, in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Embodiments of the present invention provide a phased-array antenna filter and diplexer for a super economical broadcast system.

According to one aspect of the present invention, cell spacing, i.e., the distance between adjacent BTSs, is advantageously increased relative to conventional cellular systems while providing a consistent quality of service (QoS) within each cell. Preferred embodiments of the present invention increase the range of each BTS. Conventional macrocells typically range from about ¼ mile (400 meters) to a theoretical maximum of 22 miles (35 kilometers) in radius (the limit under the GSM standard); in practice, radii on the order of 3 to 6 mi (5-10 km) are employed except in high-density urban areas and very open rural areas. The present invention provides full functionality at the GSM limit of 22 mi, for typical embodiments of the invention, and extends well beyond this in some embodiments. Cell size remains limited by user capacity, which can itself be significantly increased over that of conventional macrocells in some embodiments of the present invention.

Commensurate with the increase in cell size, the BTS antenna tower height is increased, retaining required line-of-sight (for the customary 4/3 diameter earth model) propagation paths for the enlarged cell. Preferred embodiments of the present invention increase the height of the BTS antenna tower from about 200 feet (60 meters) anywhere up to about 1,500 ft (about 500 m). In order for the transmit power and receive sensitivity of a conventional cellular transceiver (user's hand-held mobile phone, data terminal, computer adapter, etc.) to remain largely unchanged, both the EIRP and receive sensitivity of the tower-top apparatus for the SEC system are increased at long distances relative to conventional cellular systems and reduced near the mast. These effects are achieved by the phased-array antenna and associated passive components, as well as active electronics included in the present invention.

Standard BTS equipment, such as transceivers, electric power supplies, data transmission systems, temperature control and monitoring systems, etc., may be advantageously used within the SEC system. Generally, from one to three or more cellular operators (service providers) may be supported simultaneously at each BTS, featuring, for example, 36 to 96 transceivers and 216 to 576 Erlang of capacity. Alternatively, more economical BTS transmitters (e.g., 0.1 W transmitter power) may be used by the cellular operators, further reducing cost and energy consumption. These economical BTSs have a smaller footprint and lower energy consumption than previous designs, due in part to performance of transmitted signal amplification and received signal processing at the top of the phased-array antenna tower rather than on the ground.

Figure 1:
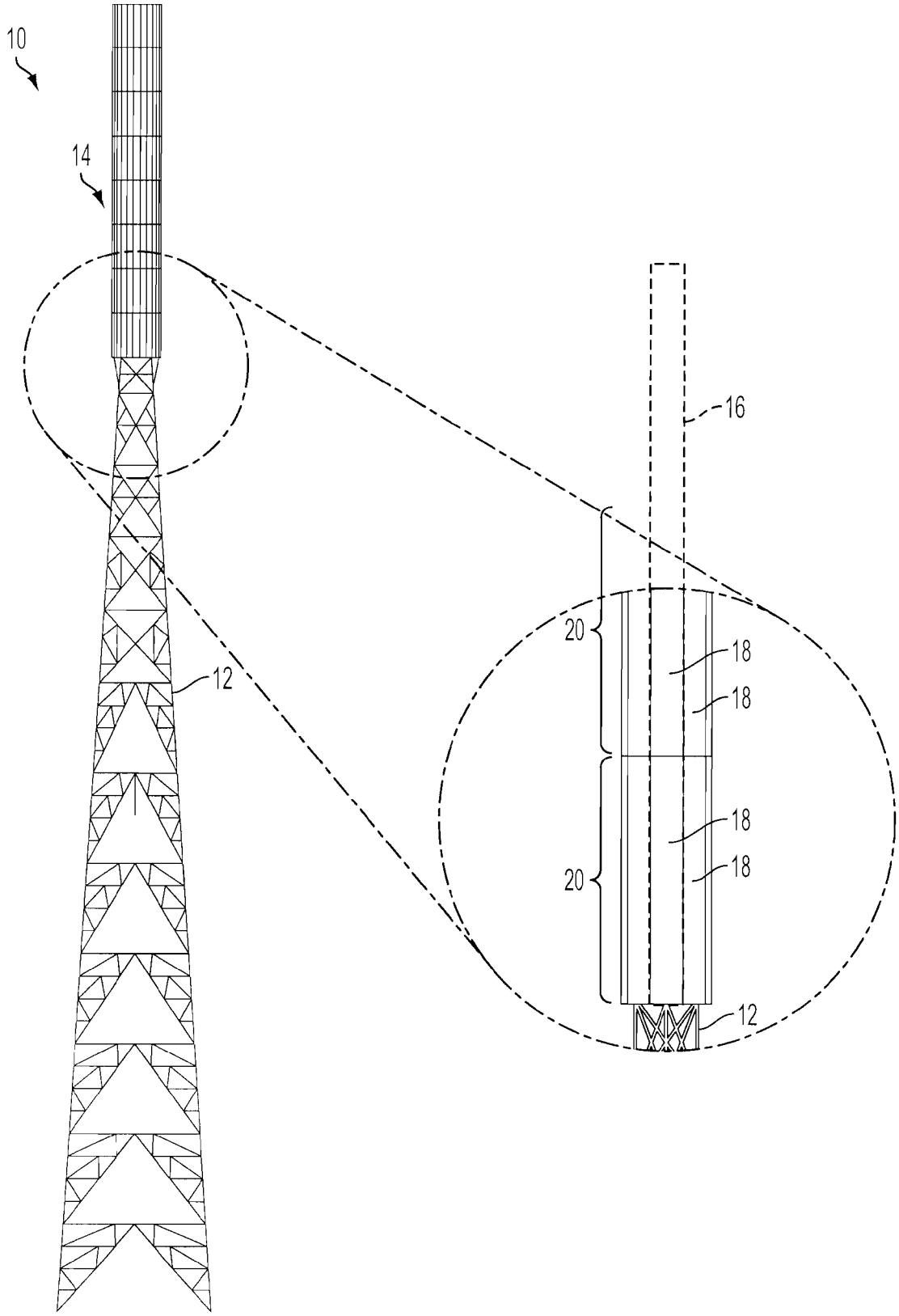
FIG. 1 depicts a perspective view of a base transceiver station antenna, in accordance with an embodiment of the present invention.

FIG. 1 presents a perspective view of a BTS antenna, in accordance with an embodiment of the present invention.

The base transceiver station 10 includes an antenna tower 12 and a phased-array antenna 14, with the latter disposed on an upper portion of the tower 12, shown here as the tower top. The antenna 14 in the embodiment shown is generally cylindrical in shape, which serves to reduce windload, and has a number of sectors 16, such as, for example, 6 sectors, 8 sectors, 12 sectors, 18 sectors, 24 sectors, 30 sectors, 36 sectors, etc., that collectively provide omnidirectional coverage for a cell associated with the BTS. Each sector 16 includes a number of antenna panels 18 in a vertical stack. Each elevation 20 includes a number of antenna panels 18 that can surround a support system to provide 360° coverage at a particular height, with each panel 18 potentially belonging to a different sector 16. Each antenna panel 18 includes a plurality of vertically-arrayed radiators, which are enclosed within radomes that coincide in extent with the panels 18 in the embodiment shown.

Feed lines, such as coaxial cable, fiber optic cable, etc., connect cellular operator equipment to the antenna feed system located behind the respective sectors 16. At the input to the feed system for each sector 16 are diplexers, power transmission amplifiers, low-noise receive amplifiers, etc., to amplify and shape the signals transmitted from, and received by, the phased-array antenna 14. In one embodiment, the feed system includes rigid power dividers to interconnect the antenna panels 18 within each sector 16, and to provide vertical lobe shaping and beam tilt to the panels 18 in that sector. In another embodiment, flexible coaxial cables may be used within the feed system.

Figure 2:
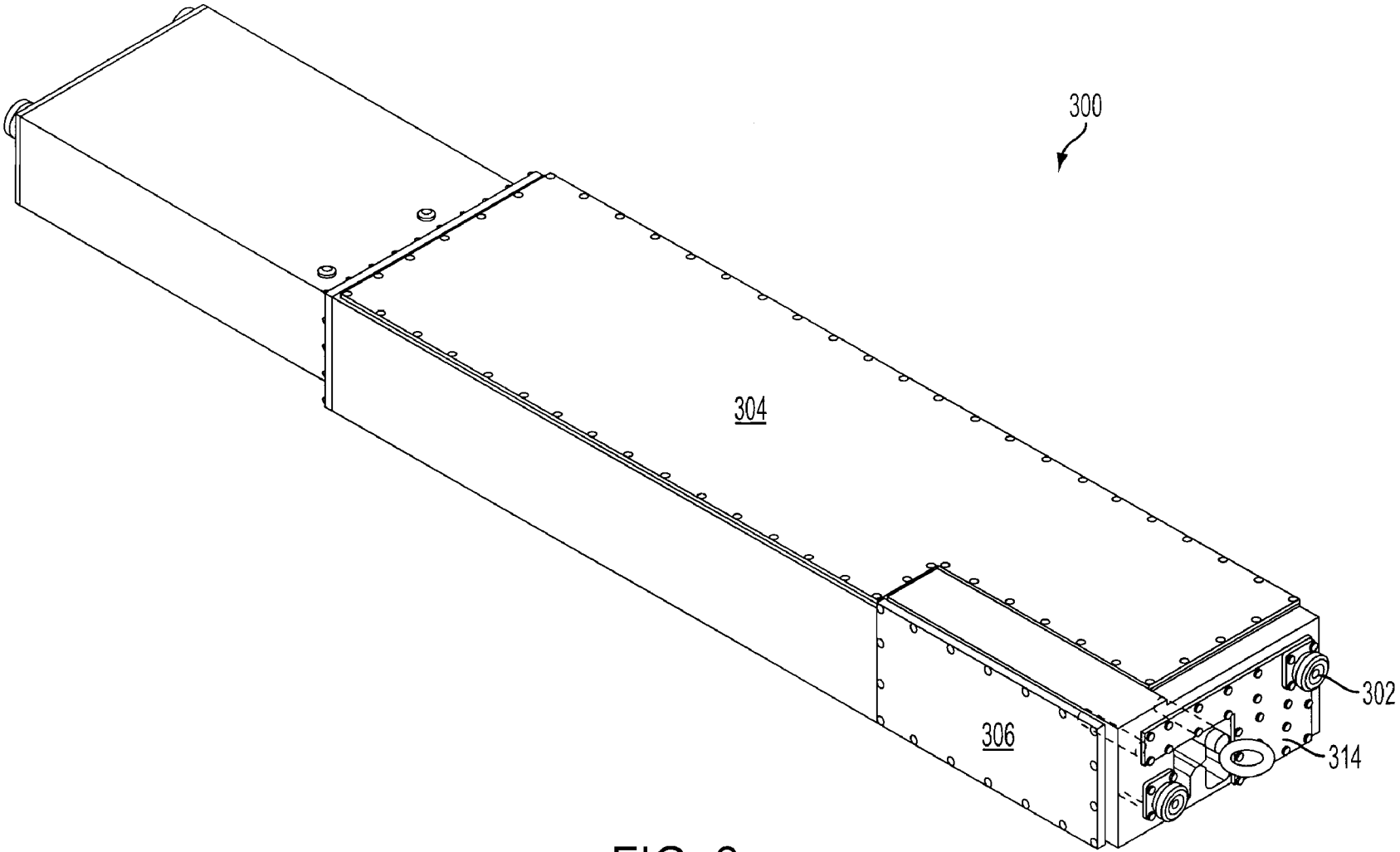
FIG. 2 is a perspective view of a filter and diplexer, in accordance with an embodiment of the present invention.

FIG. 2 shows a perspective view of a filter and diplexer assembly 300 compatible with an antenna 10 array as shown in FIG. 1. Placement and configuration of the antenna port 302 allow the diplexer 314, and receive (RX) and transmit (TX) filters 304 and 306, respectively, to be placed within a single envelope 300 having compact overall dimensions. Each two of the four ports serving a vertical panel stack are combined and coupled to one of two such filter and diplexer assemblies 300.

Figure 3:
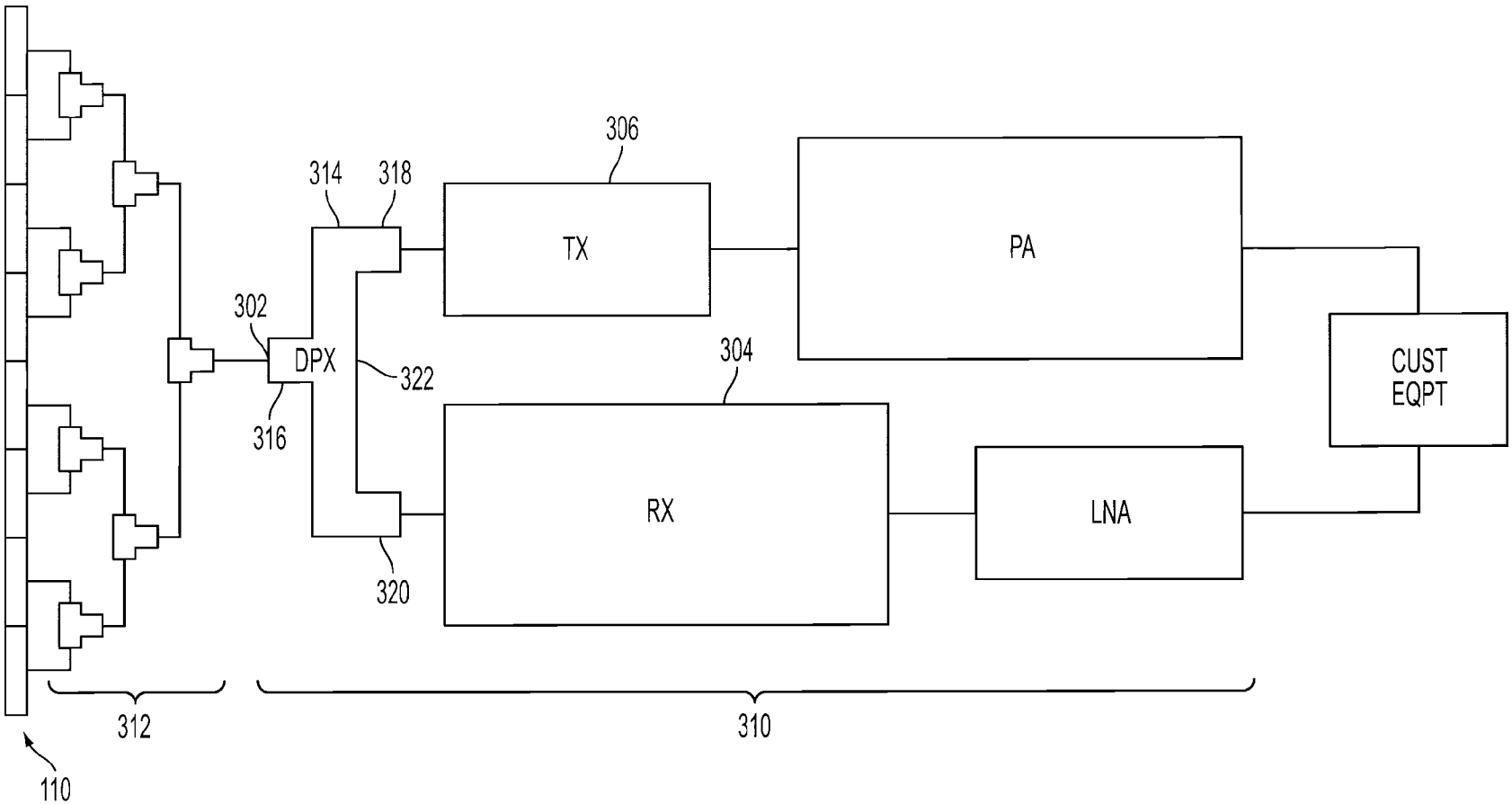
FIG. 3 is a schematic view of a filter and diplexer, in accordance with an embodiment of the present invention.

FIG. 3 summarizes diplexer structure in schematic form 310. The antenna port 302 is the interface between the antenna feed system 312 and the filter and diplexer 300. The diplexer 314 functions as a frequency-sensitive signal divider tee with a common leg 316, a transmit leg 318 with a transmit port 319, and a receive leg 320 with a receive port 321. Receive signals applied to the common leg 316, for example, upon reaching the tee branch point 322 within the diplexer 314, are coupled along the low-frequency (receive) leg 320, because the high-frequency transmit leg 318 is a quarter-wavelength stub (at the receive frequencies) terminated at its other end by the transmit filter 306 output port 324, discussed below; the transmit filter 306 appears as a short circuit at all receive-signal frequencies. Thus, the transmit leg 318 path appears as an open circuit at the tee branch point 322. The receive leg 320, however, is dimensioned to pass received signals to the receive filter 304, which has impedance substantially matched to that of the diplexer 314 signal path over the range of received signals.

Similarly, transmit signals applied to the transmit leg 318, upon propagating to the tee branch point 322, are coupled along the common leg 316 and thence to the radiators 110, because the receive filter 304 input port 326 appears as a short circuit to the transmit frequencies, so that the path to the receive leg 318 presents an open circuit a quarter-wavelength (at the transmit frequencies) removed therefrom.

The respective filters 304, 306 have transfer functions, e.g., filter type, number and placement of poles, feedback paths, etc., selected for the power levels and the allowable insertion loss associated with respective receive or transmit functionality.

Figure 4:
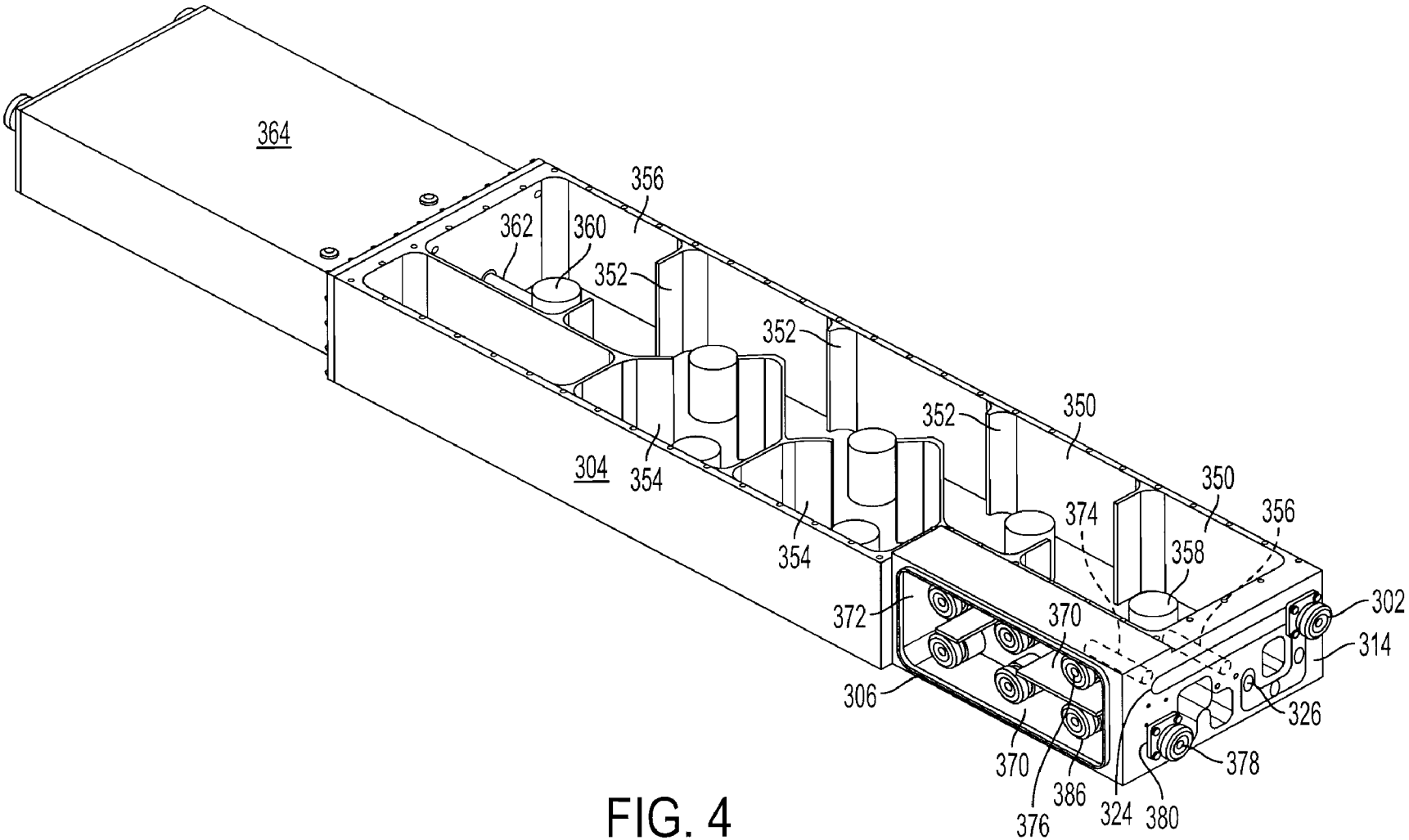
FIG. 4 is a perspective view of a filter and diplexer with the covers removed, in accordance with an embodiment of the present invention.

FIG. 4 shows the filter and diplexer assembly 300 of FIG. 2 with the covers removed. Each of the filters 304, 306 in the embodiment shown provides particular combinations of capabilities that are required to permit performance of the required functions, and that significantly constrain the designs.

In one embodiment, a maximally-flat 7-pole receive filter 304 uses cascaded, serpentine-arranged, and resonator-loaded tuned cavities 350, with bandwidth-determining tuning screws (not shown) in the coupling windows 352 between cavities 350. Inductive cross-coupling from one or more additional windows 354 provides transmission zeroes required to establish sufficient selectivity to reject signals over the full transmit band. By this mechanism, the receive filter input port 326 (referred to the radiators 110 and the diplexer 314) looks like a short circuit to the transmit frequency band despite being constrained to pass signals with very low insertion loss (0.5 dB attenuation), and despite being separated by only 2% from the lower limit of the transmitter frequency band. Out-of-band rejection can be adjusted to exceed 90 dB.

In accommodating the closer-spaced P-, E-, and R-GSM frequency ranges, the filter 304 supports being retuned to lower out-of-band rejection. Other embodiments (not shown) can be configured with more poles to provide the same rolloff as the filter 304 shown, with its wider-separated pass and stop bands. It is to be understood that physical size is a principal factor in quality (Q) in passive, resonator-loaded, tuned cavity filters—that is, pass and stop band performance and the sharpness of separation therebetween—comparable in importance to and interacting with the number of poles. Thus, in order to at least maintain a comparable Q while increasing pass band width and decreasing stop band width, a filter otherwise comparable to that shown may require not only more poles but also an increase in the size of each cavity.

The receive filter 304 input port 326, i.e., the diplexer 314 receiver-side port, is located within the filter 300 housing, and provides an input conductive link 356 (shown dashed) to the first receive filter resonator 358. The filtered signal appears at the distal end of the cavity, where the last receive filter resonator 360 couples the filtered signal via an output conductive link 362 to the low-noise amplifier 364.

In one embodiment, a cross-coupled transmitter filter 306 places two low-side transmission zeroes within a folded 6 pole design. This complex cross-coupling, i.e., a capacitive and an inductive zero below the passband, again employs cascaded, serpentine-arranged, and resonator-loaded tuned cavities 370 with tunable coupling windows 372. The configuration is tunable to provide rejection on the order of 75 dB for the receive frequency band, while positioning the filter 306 input and output ports for interconnection and reducing physical size to a limit determined by filter 306 manufacturability. The transmit filter 306 output port 324, i.e., the diplexer 314 transmitter-side port, is also located within the filter 300 housing, and provides a conductive link 374 to the last transmit filter resonator 376. The transmitter signal is applied to a feed port 378 adjacent to the diplexer antenna port 302, where an input conductive link 380 couples the broadcast signal to the first transmit filter resonator 382. As with the receive filter 304, the transmit filter 306 is broadenable over a range in exchange for lowered Q, and can be increased in size and number of stages if needed to accommodate a wider band in conjunction with preservation or increase of Q. The smaller physical size shown is consistent with more relaxed performance, by some 15 dB, than the receive filter 304.

Material cost of the filter and diplexer 300 can be controlled in part through selection of a unitary machined or cast block of a free-machining or castable/machineable aluminum alloy or comparable material for the diplexer 314 and the transmit 306 and receive 304 filters. In other embodiments, fabrication from multiple plates, for example, may be preferred. It is to be observed that the resonator elements within each filter are oriented in parallel positions, an arrangement compatible with milling the respective chambers from one side. In other embodiments, orientations may be varied, subject to constraints of performance requirements and ease of fabrication. The transmitter filter occupies only about 10% of the volume of the receiver filter despite being some 93 dB higher in signal power level. The transmitter filter output port 324 (to the diplexer 314) looks like a short circuit to the receive filter 304 signal input port 356.

General design rules permit any functional filter designs, such as the cascaded resonant cavity filters 304, 306 shown, to be applied to each of the respective transmit and receive parts, within the constraint that they be laid out with their respective antenna ports oriented to couple to first and second diplexer ports, and that the respective antenna-side port impedances provide requisite transmit-to-receive isolation at the third diplexer port. Physical dimensions may be constrained by the width of radiator panel backplane extrusions, availability of mounting locations behind the panels in view of feed and structural support hardware presence, and a weight budget.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A phased-array antenna filter and diplexer for a cellular communication system, comprising:

a signal divider tee diplexer including a tee branch point, an antenna port, a diplexer transmit port and a diplexer receive port;

a receive filter including a maximally-flat, multi-pole bandpass filter, a receive input port and a receive output port, the receive input port coupled to the diplexer receive port to define a receive signal path, from the tee branch point to the receive input port, having a length of approximately one quarter receive wavelength; and a transmit filter including a folded, multi-pole bandpass filter, a transmit input port and a transmit output port, the transmit output port coupled to the diplexer transmit port to define a transmit signal path, from the tee branch point to the transmit output port, having a length of approximately one quarter transmit wavelength, wherein the antenna port transfers signal energy bidirectionally with at least one radiator stack of an antenna.

2. The phased-array antenna filter and diplexer of claim 1, wherein the diplexer antenna port transfers signal energy bidirectionally with two of four radiator stacks of an antenna.

3. The phased-array antenna filter and diplexer of claim 1, wherein the diplexer includes a common leg, a transmit leg, and a receive leg.

4. The phased-array antenna filter and diplexer of claim 3, wherein the transmit leg of the diplexer appears as an open circuit to signals at a frequency range of the receive leg.

5. The phased-array antenna filter and diplexer of claim 3, wherein the receive leg of the diplexer appears as an open circuit to signals at a frequency range of the transmit leg.

6. A phased-array antenna filter and diplexer for a cellular communication system, comprising:

a signal divider tee diplexer including a tee branch point, an antenna port, a diplexer transmit port and a diplexer receive port;

a receive filter including a maximally-flat, multi-pole bandpass filter, a receive input port and a receive output port, the receive input port coupled to the diplexer receive port to define a receive signal path, from the tee branch point to the receive input port, having a length of approximately one quarter receive wavelength;

a transmit filter including a folded, multi-pole bandpass filter, a transmit input port and a transmit output port, the transmit output port coupled to the diplexer transmit port to define a transmit signal path, from the tee branch point to the transmit output port, having a length of approximately one quarter transmit wavelength; and a unitized envelope enclosing the diplexer, the transmit filter and the receive filter.

7. The phased-array antenna filter and diplexer of claim 6, wherein the unitized envelope is a unitary machined or cast block of a free-machining or castable/machineable aluminum alloy.

8. The phased-array antenna filter and diplexer of claim 7, further comprising resonator elements that are oriented in parallel positions, compatible with milling a respective chambers of the unitized envelope from one side.

9. A phased-array antenna filter and diplexer for a cellular communication system, comprising:

a signal divider tee diplexer including a tee branch point, an antenna port, a diplexer transmit port and a diplexer receive port;

a receive filter including a maximally-flat, multi-pole bandpass filter, a receive input port and a receive output port, the receive input port coupled to the diplexer receive port to define a receive signal path, from the tee branch point to the receive input port, having a length of approximately one quarter receive wavelength; and a transmit filter including a folded, multi-pole bandpass filter, a transmit input port and a transmit output port, the transmit output port coupled to the diplexer transmit port to define a transmit signal path, from the tee branch point to the transmit output port, having a length of approximately one quarter transmit wavelength, wherein the receive filter is a maximally-flat 7-pole bandpass filter and includes cascaded, serpentine-arranged, and resonator-loaded tuned cavities, with bandwidth-determining tuning screws disposed in coupling windows between the cavities.

10. The phased-array antenna filter and diplexer of claim 9, wherein the receive filter includes at least one transmission zero realized through inductive cross-coupling from a predetermined number of additional windows.

11. The phased-array antenna filter and diplexer of claim 9, wherein the receive filter is tunable to lower out-of-band rejection.

12. A phased-array antenna filter and diplexer for a cellular communication system, comprising:

a signal divider tee diplexer including a tee branch point, an antenna port, a diplexer transmit port and a diplexer receive port;

a receive filter including a maximally-flat, multi-pole bandpass filter, a receive input port and a receive output port, the receive input port coupled to the diplexer receive port to define a receive signal path, from the tee branch point to the receive input port, having a length of approximately one quarter receive wavelength;

a transmit filter including a folded, multi-pole bandpass filter, a transmit input port and a transmit output port, the transmit output port coupled to the diplexer transmit port to define a transmit signal path, from the tee branch point to the transmit output port, having a length of approximately one quarter transmit wavelength; and the receive filter further comprises: a first conductive link from a diplexer receiver-side port to a first receiver filter resonator; and a second conductive link from a last receiver filter resonator to a low-noise amplifier.

13. The phased-array antenna filter and diplexer of claim 12, wherein an increased number of poles and an increased cavity size narrows a receive reject band.

14. A phased-array antenna filter and diplexer for a cellular communication system, comprising:

a signal divider tee diplexer including a tee branch point, an antenna port, a diplexer transmit port and a diplexer receive port;

a receive filter including a maximally-flat, multi-pole bandpass filter, a receive input port and a receive output port, the receive input port coupled to the diplexer receive port to define a receive signal path, from the tee branch point to the receive input port, having a length of approximately one quarter receive wavelength; and a transmit filter including a folded, multi-pole bandpass filter, a transmit input port and a transmit output port, the transmit output port coupled to the diplexer transmit port to define a transmit signal path, from the tee branch point to the transmit output port, having a length of approximately one quarter transmit wavelength, wherein the transmit filter is a folded 6-pole bandpass filter including a conductive link from a last transmitter filter resonator to a diplexer transmit-side port.

15. The phased-array antenna filter and diplexer of claim 14, wherein the folded 6 pole transmit filter includes a cross-coupled filter having two low-side transmission zeroes.

16. The phased-array antenna filter and diplexer of claim 15, wherein the transmit filter includes:

complex cross-coupling with a capacitive and an inductive zero below a passband;

cascaded, serpentine-arranged, and resonator-loaded tuned cavities within the passband; and tunable coupling windows.

* * * * *